US008199955B2

(12) United States Patent
Akino

(10) Patent No.: US 8,199,955 B2
(45) Date of Patent: Jun. 12, 2012

(54) HEADPHONES WITH A PRESSURE CONTROLLING MECHANISM

(75) Inventor: Hiroshi Akino, Machida (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 555 days.

(21) Appl. No.: 12/398,605

(22) Filed: Mar. 5, 2009

(65) Prior Publication Data

US 2009/0226023 A1 Sep. 10, 2009

(30) Foreign Application Priority Data

Mar. 7, 2008 (JP) ..... 2008-057805

(51) Int. Cl.
*H04R 1/02* (2006.01)

(52) U.S. Cl. ..... 381/374; 381/332; 381/387

(58) Field of Classification Search ..... 381/374
See application file for complete search history.

(56) References Cited

U.S. PATENT DOCUMENTS 3,798,393 A * 3/1974 Gorike ..... 381/372
2008/0170710 A1* 7/2008 Pasternak ..... 381/74

FOREIGN PATENT DOCUMENTS

JP 2003-017990 A 1/2003
JP 2003-032768 A 1/2003

* cited by examiner

*Primary Examiner* — Anh Mai
*Assistant Examiner* — Christopher Uhlir
(74) *Attorney, Agent, or Firm* — Sughrue Mion, PLLC

(57) ABSTRACT

A headphone with a configuration that prevents breaking of components and failure to play sounds properly due to a pressure change within spaces in the headphone, comprising: a baffle board; an ear pad provided at a periphery of the baffle board and surrounding an area around an auricle of a user; an electro-acoustic transducer provided at a central portion of the baffle board and including a diaphragm and a magnetic pole that oscillates the diaphragm, as major components; and a headphone housing forming a rear space on a side opposite to the ear pad of the baffle board and covering the electro-acoustic transducer: and the electro-acoustic transducer is supported by a frame member arranged in an opening of the baffle board and integrally combined with the baffle board, and the frame member includes a valve that eliminates a pressure difference between a space around the auricle and the rear space.

11 Claims, 7 Drawing Sheets

RELATED ART

RELATED ART

HEADPHONES WITH A PRESSURE CONTROLLING MECHANISM

BACKGROUND OF THE INVENTION

1. Field of the Invention

The present invention relates to headphones, and in particular, relates to a pressure controlling mechanism for sound-isolating headphones.

2. Description of the Related Art

A sound isolating headphone is known as a personal speaker that is worn on a head with auricles covered therein.

As examples in related art, sound-isolating headphones with configurations disclosed in Patent Documents 1 and 2 are known.

FIG. 6 shows a configuration of a headphone disclosed in Patent Document 1. In FIG. 6, a headphone includes an electro-acoustic transducer formed by combining a yoke B, a magnet C, and a pole piece D which are provided on a base A with a voice coil E1 which is provided at a dome diaphragm E side. The electro-acoustic transducer is disposed at the center of a headphone housing F having an enclosure structure.

A baffle board G is integrally combined with the headphone housing F. An ear pad H is provided on the baffle board G. The baffle board G is facing a front end portion of each voice coil E1 of the electro-acoustic transducer, and a plurality of openings G1 are formed in the baffle board G.

FIG. 7 shows a configuration of a headphone disclosed in Patent Document 2. In FIG. 7, a driver unit (electro-acoustic transducer) P is disposed behind a baffle board K having numerous through holes. A sub-housing L is provided behind the driver unit P, that is, at a rear space side formed by the headphone housing F. An acoustic-resisting member M composed of a buffer material is provided at an opening L1 formed on the sub-housing L.

This configuration improves sound insulation of sound-isolating headphones.

In terms of the sound insulation, for example, an active noise-canceling headphone (not shown) is known that has a microphone therein to detect noise from outside and emits a tone of an opposite phase signal to counter the noise.

[Patent Document 1] Japanese Patent Application Laid-open No. 2003-32768

[Patent Document 2] Japanese Patent Application Laid-open No. 2003-17990

Problems to be Solved by the Invention

In sound-isolating headphones, a space around an auricle is shielded from another space at a headphone housing side by an electro-acoustic transducer or a baffle board including the electro-acoustic transducer. Accordingly, change of pressure in the spaces may sometimes break components in the electro-acoustic transducer, e.g., a diaphragm and a voice coil in particular, or lose the proper positioning of the components. When this happens, sounds may not be played properly. Further, with the noise-canceling headphone, the pressure may affect the microphone to produce unwanted sound that makes the user uncomfortable.

When the user wears a headphone, an ear pad is first pressed against a side of the head so that the headphone is in close contact with the head and then released. Upon pressing, due to shrinkage deformation of the ear pad, a space around the auricle shrinks to increase internal pressure. Upon releasing, the shape of the pad returns to its original form to make the space larger and the pressure within the space tends to be negative.

When the pressure is increased, the voice coil may collide with the magnet and break. When the pressure within the space tends to be negative, the voice coil may slip out of the position facing the magnet. Thus, the proper positioning of the voice coil and the magnet facing each other is lost and sounds cannot be played properly.

SUMMARY OF THE INVENTION

To solve the problems of the headphones in related art, the present invention provides a headphone with a configuration that prevents breaking of components and failure to play sounds properly due to a pressure change within the spaces in the headphone.

In view of the above, an aspect of the present invention provides a headphone including: a baffle board; an ear pad provided at a periphery of the baffle board and surrounding an area around an auricle of a user; an electro-acoustic transducer provided at a central portion of the baffle board and having, as major components, a diaphragm, and a magnetic pole that oscillates the diaphragm; and a headphone housing forming a rear space on a side opposite to the ear pad of the baffle board and covering the electro-acoustic transducer. The electro-acoustic transducer is supported by a frame member integrally combined with the baffle board in an opening of the baffle board. The frame member includes a valve that eliminates a pressure difference between a space around the auricle and the rear space.

The valve may be composed of a flexible piece that opens a communicating hole penetrating the frame member in a thickness direction thereof by bending in a direction of a pressure applied.

It is preferred that the communicating hole is provided at a position different from a position where an acoustic-resisting member is provided on the frame member.

In an initial state, the valve may be set to completely close the communicating hole, or have a slight gap between the flexible piece and an opening plane of the communicating hole.

The headphone according to some aspects of the present invention includes the valve that eliminates a pressure difference between the space around the auricle and the rear space formed opposite thereto. Thus, an increase of pressure and a tendency of pressure being negative within the spaces can be eliminated by the opening and closing operation of the valve. Further, by forming the valve with a flexible piece which can bend in accordance with the direction of pressure applied, the headphone can withstand a sudden change of pressure. Accordingly, breaking of the components undergoing a sudden large movement due to the increase of pressure or the tendency of pressure being negative within the spaces can be prevented. Furthermore, a pressure change that can make the user uncomfortable can effectively be prevented.

DETAILED DESCRIPTION OF THE INVENTION

Embodiments of a headphone according to the present invention will be described with reference to the accompanying drawings.

Figure 1:
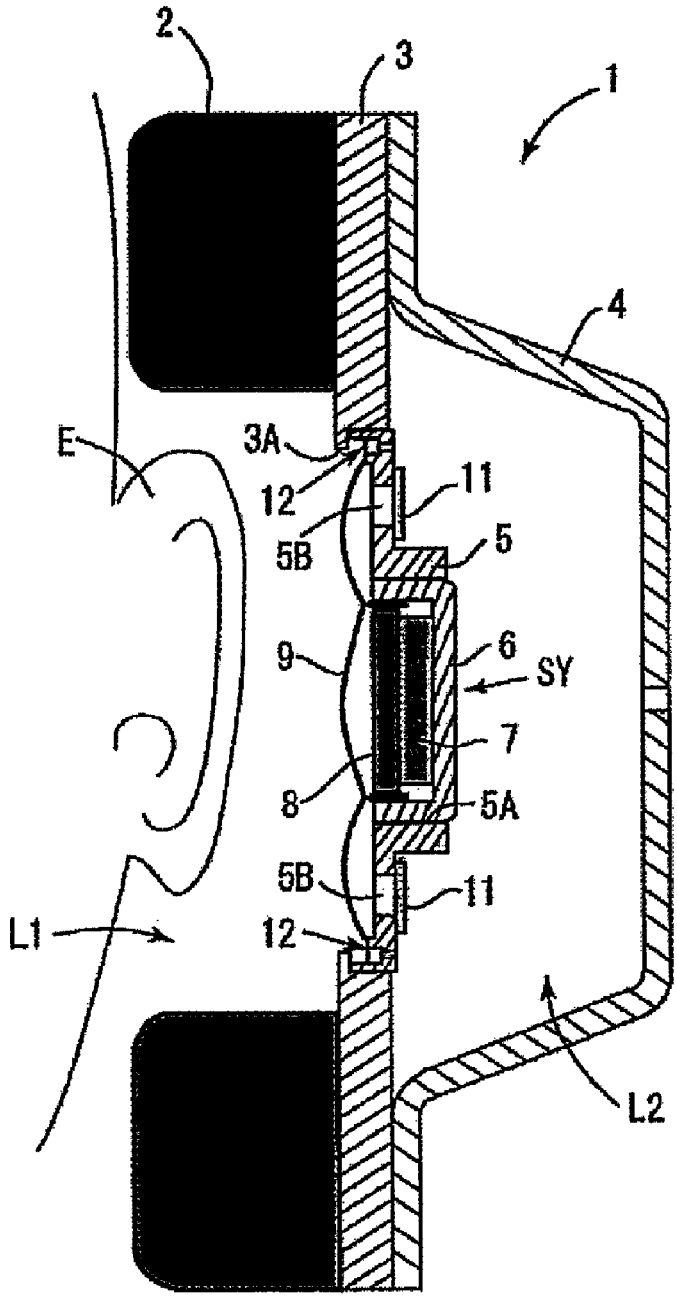
FIG. 1 is a cross-sectional view of a headphone unit according to a first embodiment of the present invention.

FIG. 1 is a cross-sectional view of a headphone unit according to a first embodiment of the present invention.

In FIG. 1, a headphone unit 1 includes a ring-shaped ear pad 2 surrounding an auricle E and is combined with one side of a baffle board 3 with any appropriate techniques. The torus-shaped baffle board 3 has an opening 3A in the center. The ear pad 2 and the baffle board 3 are integrally combined at the periphery side of the opening 3A so that the circumference surfaces of the ear pad 2 and the baffle board 3 are substantially coplanar. The baffle board 3 is integrally combined with a headphone housing 4 having a cylindrical shape with a bottom capable of forming a space covering an area around an auricle of the user. An electro-acoustic transducer SY is provided at the opening 3A of the baffle board 3.

The electro-acoustic transducer SY is also referred to as a driver unit and includes: a base frame 5 having an opening 5A in the center; a petri dish-shaped yoke 6 which is flatter and has a smaller diameter compared to the base frame 5, fitted to the opening 5A of the base frame 5; a flat magnet 7 fixed to the center of the inner bottom of the yoke 6; a plate-like pole piece 8 fixed to a face of the magnet 7; and a voice coil cylindrically wound around a dome diaphragm 9 to be integrally combined thereto.

On the base frame 5, a plurality of penetrating holes 5B where acoustic-resisting members 11 are attached are provided. With the acoustic-resisting members 11 made of felt or the like, the penetrating holes 5B serve as a sound absorbing unit.

The base frame 5 also includes a feature of the present invention, namely, valves 12 that eliminate a pressure difference between spaces.

Figure 2:
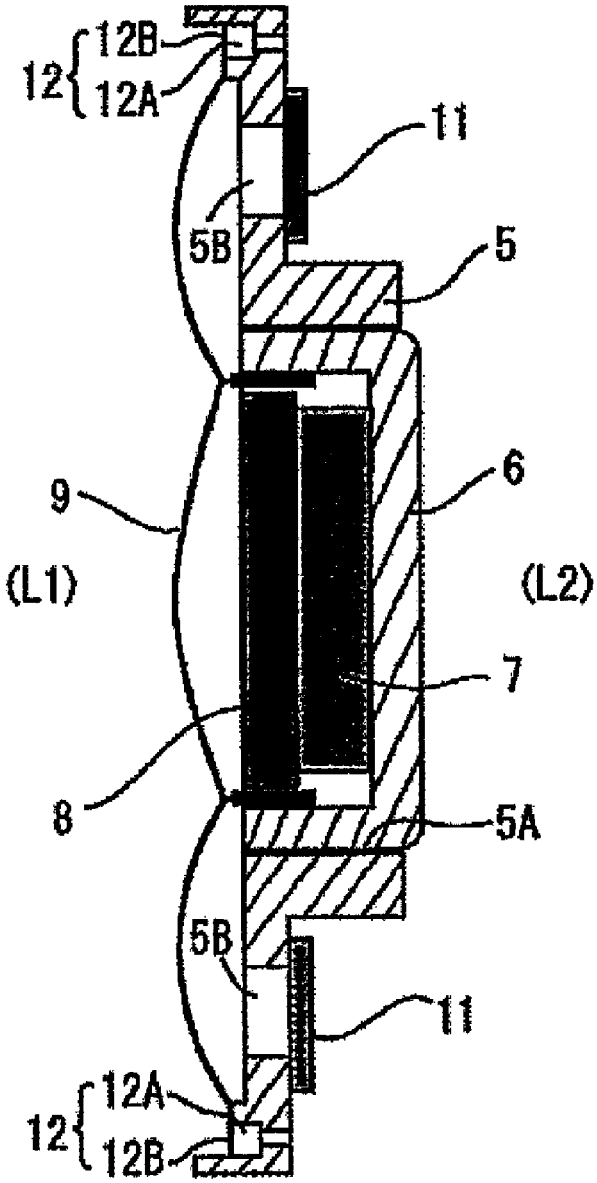
FIG. 2 is an enlarged view of a base frame in the headphone unit in FIG. 1.

FIG. 2 is an enlarged view of the base frame 5. In FIG. 2, each valve 12 includes: a communicating hole 12A provided at positions different from positions where the penetrating holes 5B for attaching the acoustic-resisting members 11 are provided at the base frame 5; and a flexible piece 12B that opens and closes the corresponding communicating hole 12A.

When the user is using the headphone, the ear pad 2 is contacted to a side of the face of the user with a pressure applied to form a space L1 surrounded by the ear pad 2, and enclosed with the side of the face, a part of the baffle board 3, and the electro-acoustic transducer SY. The communicating holes 12A penetrate in the thickness direction of the base frame 5. Thus, the space L1 and a rear space L2 formed at the headphone housing 4 side (see FIG. 1) can be in communication. The flexible pieces 12B are provided at one opening end of the communicating holes 12A in the penetrating direction, specifically, at the opening end on the ear pad 2 side in FIG. 2.

In FIG. 2, the communicating holes 12A are constituted of, in the thickness direction of the base frame 5, two portions: a small-diameter portion, and a large-diameter portion. The two portions are continuously formed.

Thus, the flexible pieces 12B, described later in detail with reference to FIG. 3, can swing without causing interference at disposed positions of the flexible pieces 12B regardless of whether the pressure applied increases or tends to be negative. Therefore, the number of components used for eliminating the pressure change can be reduced.

As shown in FIG. 3, each flexible piece 12B is a flexible sheet fixed in a cantilever manner. Specifically, a base end is fixed to a periphery of the opening end at the large-diameter portion of the corresponding communicating hole 12A, whereas the other end of the flexible pieces 12B can swing within the large-diameter portion of the opening plane of the corresponding communicating hole 12A so as to open and close the corresponding communicating hole 12A. Thus, the other sides of the flexible pieces 12B can bend in a swinging manner in the direction of the pressure applied to the flexible pieces 12B.

Figures 3A, 3B, 3C:
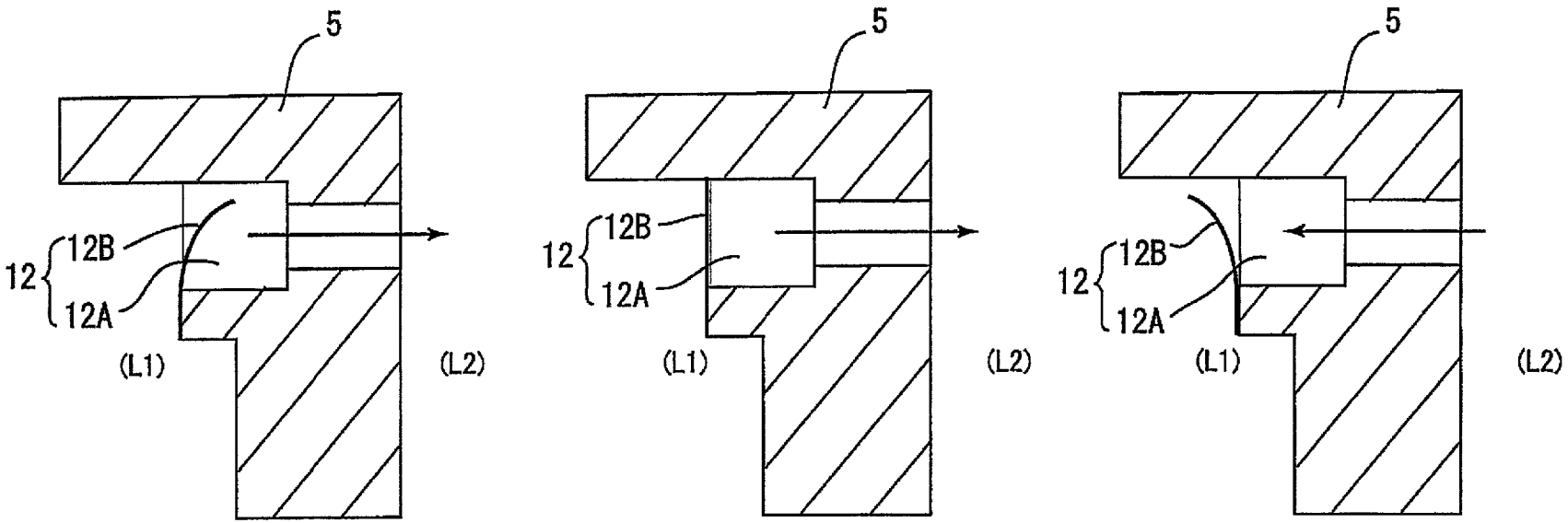
FIG. 3A is an enlarged cross-sectional view showing a configuration and an operation of a valve provided at the base frame in FIG. 2 when there is a pressure difference between spaces.
FIG. 3B is an enlarged cross-sectional view showing a configuration and an operation of the valve when there is no pressure difference between the spaces.
FIG. 3C is an enlarged cross-sectional view showing a configuration and an operation of the valve when there is a pressure difference between the spaces in a reverse way as that in FIG. 3A.

The flexible pieces 12B swing in accordance with the pressure difference between the spaces L1 and L2. Therefore, when there is no pressure difference between the spaces L1 and L2, as shown in FIG. 3B, the flexible pieces 12B close the opening planes of the communicating holes 12A, which is set as an initial state. When a pressure difference between the spaces L1 and L2 is generated, as shown in FIGS. 3A and 3C, the flexible pieces 12B open the communicating holes 12A by bending in the direction of the pressure applied.

In the initial state as shown in FIG. 3B, the space L1 on the ear pad 2 side is in a closed state as in a configuration without the communicating holes 12A. Thus, the acoustic-resisting member 11 operates effectively and predefined acoustic characteristics can be obtained.

The flexible pieces 12B are made of a sheet such as a Mylar film and a nonwoven fabric having sufficient flexible rigidity for promptly opening the communicating holes 12A with a slight pressure difference.

With the configuration of the first embodiment, the pressure in the space L1 on the ear pad 2 side is increased when the ear pad 2 is pressed against the auricle upon wearing the headphone unit 1, while the pressure is reduced due to the a tendency of pressure being negative in the space on the ear pad 2 side when the pressing is released or the headphone unit 1 is removed from the auricle. In both cases, the flexible pieces 12B of the valves 12 swing in the direction of pressure applied from the spaces L1 or L2 to open the communicating holes 12A. This facilitates air flow between the spaces L1 and L2 to eliminate the pressure change promptly.

Consequently, collision of the yoke 6 with the voice coil due to the increase of pressure can be prevented. Further, the voice coil can be prevented from being darted out of a magnetic gap. Accordingly, breaking of components can surly be prevented and proper playing of sounds is guaranteed.

In the first embodiment described above, the flexibility of the flexible pieces 12B may be adjusted so that the level of opening and the timing for opening the communicating holes 12A can be set as desired. Thus, acoustic characteristics may be adjusted as required.

A second embodiment according to the present invention will be described.

Figure 4:
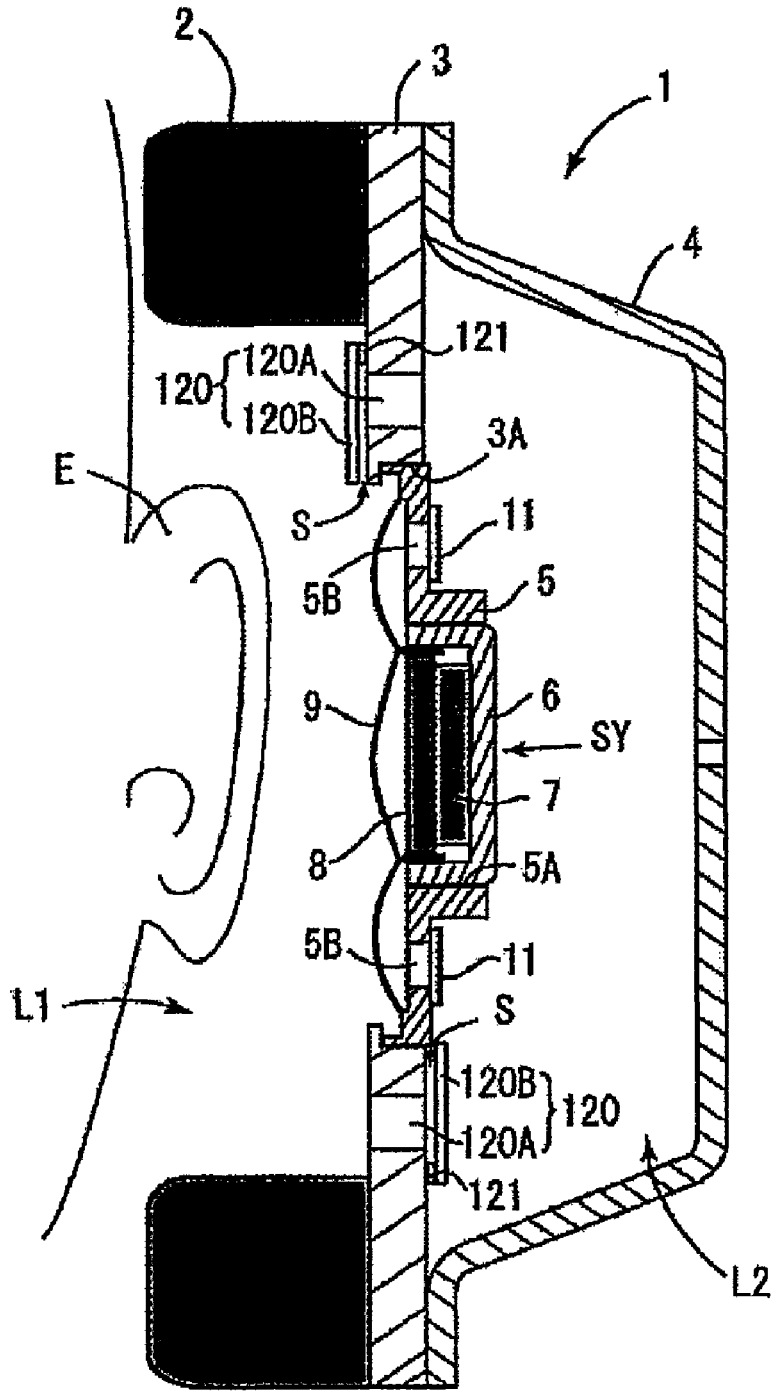
FIG. 4 is a cross-sectional view of a headphone unit according to a second embodiment of the present invention.

FIG. 4 is a cross-sectional view of the headphone unit according to the second embodiment of the present invention.

A feature of the second embodiment lies in the configuration of flexible pieces 120B provided to valves (denoted by a numeral 120 in FIG. 4) and opening and closing communicating holes 120A.

Similar to the configuration shown in FIG. 3, each flexible piece 120B is a member fixed in a cantilever manner, and only a base end is fixed to a base frame 5 so that the other end can swing. In addition, spacers 121 are provided between the base end side and the base frame 5 to provide slight gaps S between opening planes of the communicating holes 120A and the flexible pieces 120B. Accordingly, even when the flexible pieces 120B are in the initial state, the spaces L1 and L2 are communicated through the gaps S.

The configuration is different from that of the first embodiment shown in FIG. 3 in that the flexible pieces 120B are provided alternately to the front and the rear of the base frame 5 with respect to the plurality of communicating holes 120A. That is, the communicating holes 120A having the flexible pieces 120B on the front side do not have the flexible pieces 120B on the rear side, whereas the communicating holes 120A having the flexible pieces 120B on the rear side do not have the flexible pieces 120B on the front side.

Figure 5C:
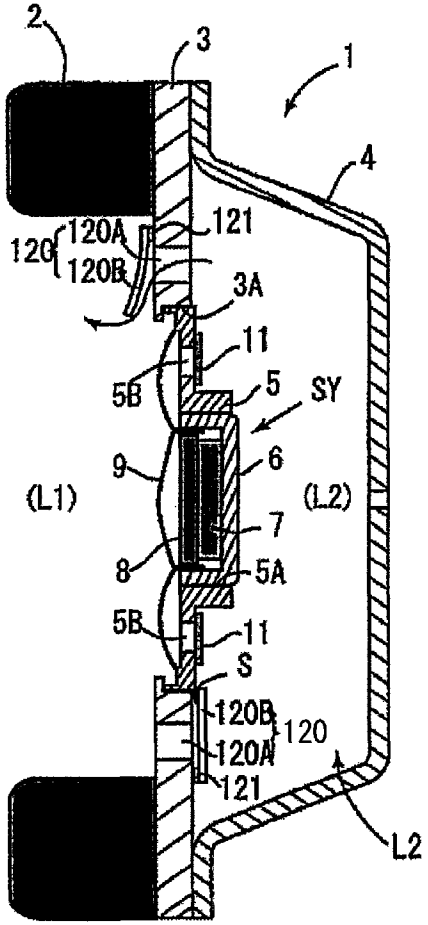
FIG. 5 shows a configuration and an operation of a valve in the headphone unit in FIG. 4.
Figure 5B:
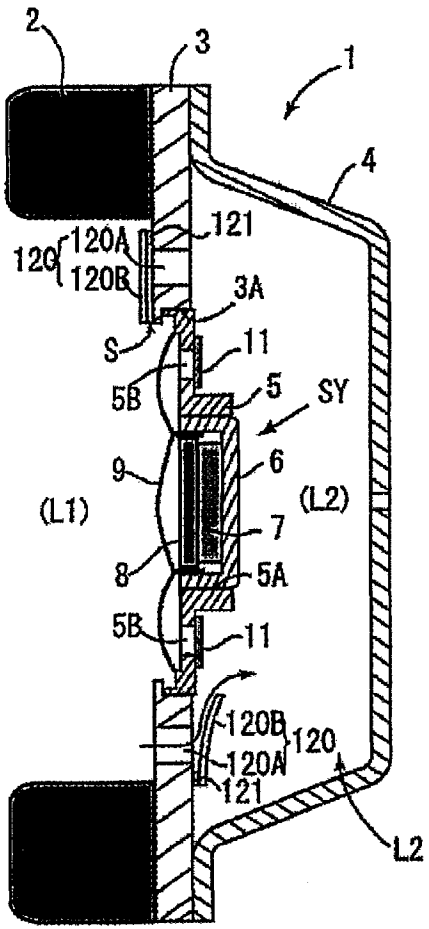
Figure 5A:
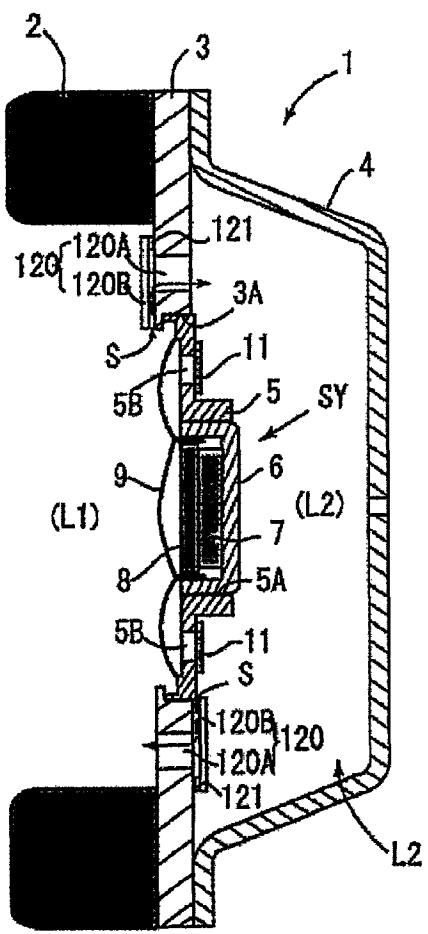
Figure 6:
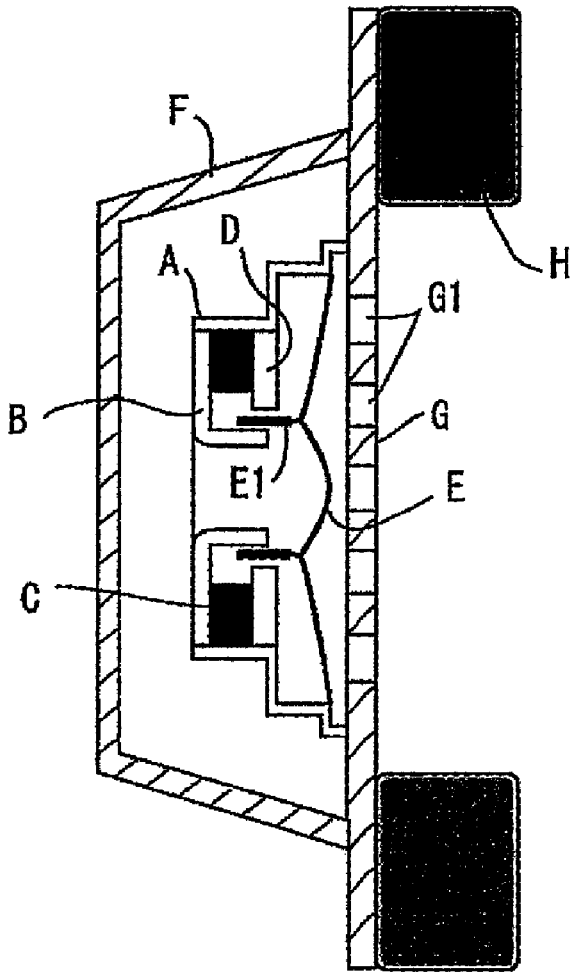
FIG. 6 shows an example of a headphone unit of related art.
Figure 7:
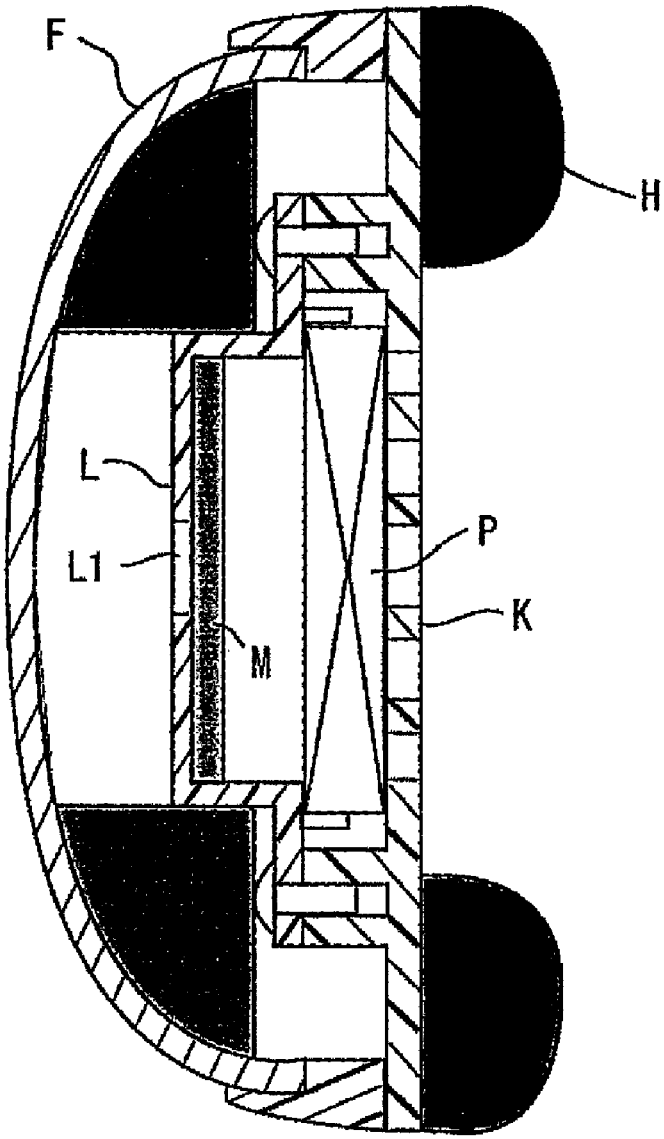
FIG. 7 shows another example of a headphone unit of related art.

In the second embodiment, when the flexible pieces 120B are in the initial state, i.e., when there is no pressure difference between the spaces L1 and L2, as shown in FIG. 5A, the flexible pieces 120B face the communicating holes 120A with the slight gaps S between the flexible pieces 120B and the opening planes of the communicating holes 120A.

The size of the gaps S is set so as to make an acoustic resistance due to an air flow resistance therein to be in parallel with the resistance of the acoustic-resisting member 11.

In the second embodiment, when there is no pressure difference between the spaces L1 and L2, the flexible pieces 120B of the valves 120 face the opening planes through the gaps S formed on the opening planes of the communicating holes 120A therebetween. As with the acoustic-resisting member 11, an acoustic pressure can be selectively controlled with the gaps S serving as air resisting-members.

Either of the flexible pieces 120B provided on the front or the rear side of the base frame 5 bends to open the opening planes when pressure in the space L1 on the ear pad 2 side of the headphone unit 1 increases as shown in FIG. 5B, or reduces due to the tendency of pressure being negative as shown in FIG. 5C.

Accordingly, the pressure difference between the spaces L1 and L2 is promptly eliminated. Thus, as in the first embodiment shown in FIG. 3, the collision of the yoke 6 with the voice coil can be prevented. Further, the voice coil can be prevented from being darted out. Accordingly, the breaking of components can surly be prevented and proper playing of sounds is guaranteed.

In addition, with the configuration in the second embodiment, the acoustic resistance can be set to a proper value by setting the length from the base end to the swinging end of the flexible pieces 120B properly because the flexible pieces 120B are provided outside the communicating holes 120A.

What is claimed is:

1. A headphone, comprising:

a baffle board;

an ear pad provided at a periphery of the baffle board and surrounding an area around an auricle of a user;

an electro-acoustic transducer provided at a central portion of the baffle board and including a diaphragm and a magnetic pole that oscillates the diaphragm, as major components; and a headphone housing forming a rear space on a side opposite to the ear pad of the baffle board and covering the electro-acoustic transducer, wherein the electro-acoustic transducer is supported by a frame member arranged in an opening of the baffle board and integrally combined with the baffle board, and the frame member includes a valve that eliminates a pressure difference between a space around the auricle and the rear space, wherein the valve is composed of a flexible piece that opens a communicating hole penetrating the frame member in a thickness direction of the frame member by bending in a direction of pressure applied.

2. The headphone according to claim 1, wherein the communicating hole is provided at a position different from a position where an acoustic-resisting member is provided on the frame member.

3. The headphone according to claim 1, wherein the valve in an initial state is set to completely close a communicating hole, or have a slight gap provided in between the flexible piece and an opening plane of the communicating hole.

4. The headphone according to claim 1, wherein the flexible piece is a flexible sheet fixed in a cantilever manner.

5. The headphone according to claim 1, wherein a base of the flexible piece is fixed to a periphery of an opening end at the communication hole and another end of the flexible piece swings within an opening plane of the communication hole.

6. The headphone according to claim 1, wherein the flexible piece is bendable in a swinging manner in a direction of applied pressure.

7. The headphone according to claim 1, wherein the communication hole comprises a continuously formed hole having a small diameter portion and a large diameter portion and wherein the flexible piece is fixed so as to open and close in the large diameter portion.

8. The headphone according to claim 7, wherein the flexible piece is a film or nonwoven fabric.

9. The headphone according to claim 1, wherein the valve comprises a plurality of communication holes and a plurality of valve members that open and close respective communication holes.

10. The headphone according to claim 9, wherein each of the plurality of valve members is fixed in a cantilever manner and wherein a base end of each of the plurality of valve members is fixed to a base of the frame.

11. The headphone according to claim 10, further comprising a plurality of spacers, each provided between the base of a respective valve member and the base of the frame forming a gap between opening plane of a respective communication hole and a respective spacer.

* * * * *